United States Patent [19]

Pfeiffer et al.

[11] Patent Number: 4,817,811

[45] Date of Patent: Apr. 4, 1989

[54] OUTLET DEVICE FOR A FLUID CONTAINER

[75] Inventors: Pierre Pfeiffer, Drulingen; Benoit Cheval, Saverne; Paul Sigwalt, Drulingen, all of France

[73] Assignee: Sotralentz S.A., Drulingen, France

[21] Appl. No.: 108,173

[22] Filed: Oct. 13, 1987

[30] Foreign Application Priority Data

Apr. 9, 1987 [FR] France ..... 87 05177

[51] Int. Cl.[4] ..... B65D 5/00

[52] U.S. Cl. ..... 220/85 SP; 220/403; 220/465

[58] Field of Search ..... 220/85 SP, 5 R, 5 A, 220/403, 465, 466; 222/529, 530, 534, 538

[56] References Cited

U.S. PATENT DOCUMENTS

| | | | |
|---|---|---|---|
| 2,861,718 | 11/1958 | Winzen | 220/465 X |
| 3,169,690 | 2/1965 | Scholle | 220/403 |
| 3,203,665 | 8/1965 | Grant et al. | 220/85 SP X |
| 4,164,304 | 8/1979 | Roberson | 220/465 |
| 4,585,143 | 4/1986 | Fremow et al. | 220/465 X |
| 4,632,282 | 12/1986 | Nagashima | 220/85 SP X |

*Primary Examiner*—Steven M. Pollard
*Attorney, Agent, or Firm*—Herbert Dubno

[57] ABSTRACT

The outlet device for a fluid container comprises an outlet pipe and an outlet hose attached with the outlet pipe so that the outlet hose is replaceable. The outlet hose can be a foldable rubber or plastic hose and is attached inside the outlet pipe. The outlet pipe is closable exteriorly by a cover. The outlet hose folded together in front of the cover is lockable inside the outlet pipe by a clamping device.

8 Claims, 3 Drawing Sheets

OUTLET DEVICE FOR A FLUID CONTAINER

FIELD OF THE INVENTION

Our present invention relates to an outlet device for a fluid container and, more particularly, to an outlet device for a fluid container with an outlet hose which is replaceable.

BACKGROUND OF THE INVENTION

In one known outlet device there is provided a hose which is generally a conventional scarcely foldable rubber tube with a fabric reinforcement. This tube is attached to the outlet pipe by a screw cap or retaining nut and is generally provided with a tap at its free end which can be opened and closed. This outlet device is little suited for a fluid container which is designed simultaneously as a transporting and storing container as well as a delivery container for the fluid filled in it.

For that purpose many containers are provided with a metal tap which is attached to the outlet pipe. That is expensive, especially when the fluid containers are disposable plastic (synthetic resin) containers.

Furthermore the use of a tap or cock causes difficulties when the outlet pipe has a large cross section as is required when the fluid in the container has a comparatively high viscosity and the emptying or dispensing time should be small. Taps of correspondingly large diameters are scarcely conventional. They are made from metal so that heavy space consuming components may have to be used although they are little suited for connection with a plastic fluid container. To an increasing degree such a container is being used directly for transport and storage of fluids, especially high viscosity fluids.

OBJECTS OF THE INVENTION

It is an object of our invention to provide an improved outlet device for a fluid container which avoids these drawbacks.

It is another object of our invention to provide an improved outlet device for a fluid container which is usable as a transporting and storing container and simultaneously as a dispensing container which can have large and very large outlet cross sections without accompanying difficulties.

It is a further object of our invention to provide an improved economical outlet device for a fluid container which is easily usable as a transporting, dispensing and storing container especially for a high viscosity fluid.

SUMMARY OF THE INVENTION

These objects and others which will become more readily apparent hereinafter are attained in accordance with our invention in an outlet device for a fluid container with an outlet pipe and with an outlet hoseconnected to the outlet pipe, the outlet hose being replaceable.

According to our invention the film or foil outlet hose has no intrinsic stiffness, is readily foldable, and is made of rubber or plastic and is attached to the inside of the outlet pipe, the outlet pipe is closable exteriorly by a cover and the outlet hose folded together in front of the cover is clamped by a releasable closure inside in the outlet pipe on which the open end of the hose is affixed by a clamping device.

Our invention uses the fact that in this outlet device the outlet hose which has no tap can fulfill an additional function, namely it can act as a hose plug during the transport and storage of a filled fluid container.

To cause an outflow it is only required that the cover of the outlet device according to our invention be removed. The folded together outlet hose is pressed outwardly under the influenoe of the hydrostatic pressure of the fluid in it. The free end of the hose can be taken and put in a receiving vessel or the like into which the fluid being dispensed flows. The clamping device can be easily removed or can be adjusted so that it springs or pops off.

In a desirable example of our invention the outlet hose has a length which is greater than the maximum height of the fluid level in the fluid container. Then the mouth of the outlet hose can be lifted until it is over the level of the fluid in the fluid container so that the discharge can be interrupted. It is understood that by compressing the mouth of the outlet hose in each dispensing configuration metering of the fluid flow is possible.

An especially simple construction and great ease of manufacture with high reliability is achieved when the outlet hose has a connecting edge inserted in a gap between the inner wall of the outlet pipe and a mounting ring and is held thereon together by a sealing ring placed on the front surface of the outlet pipe which for its part is held by an exteriorly directed clamping collar on the mounting ring.

A screw collar ring which holds the mounting ring with an interior collar is exteriorly screwed on the outlet pipe. The cover can be screwed into the mounting ring. Generally the mounting ring, the screw collar ring and the cover can be made from plastic. The fluid container for its part is made of plastic so that the outlet pipe is generally molded directly therein.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
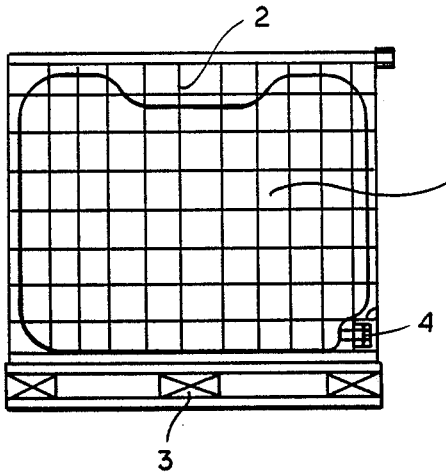
FIG. 1 is a side-elevational view of a fluid container with an outlet device according to our invention.
Figure 2:
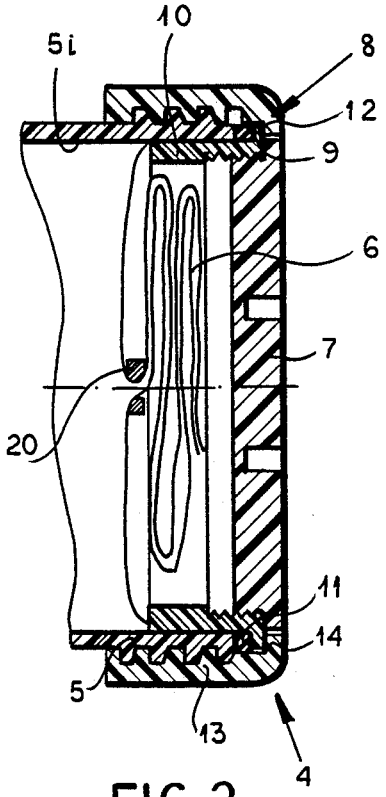
FIG. 2 is a cutaway vertical cross sectional view through the outlet device shown in FIG. 1 drawn to an enlarged scale in comparison to FIG. 1.
Figure 3:
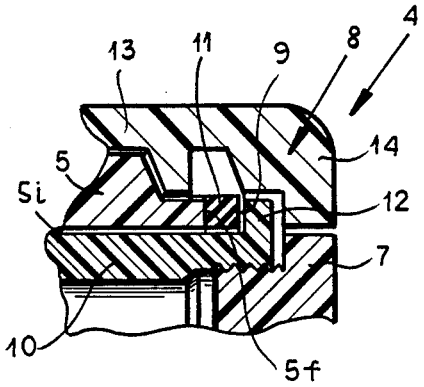
FIG. 3 is a still further enlarged cutaway cross sectional view of the object shown in FIG. 1.
Figure 4:
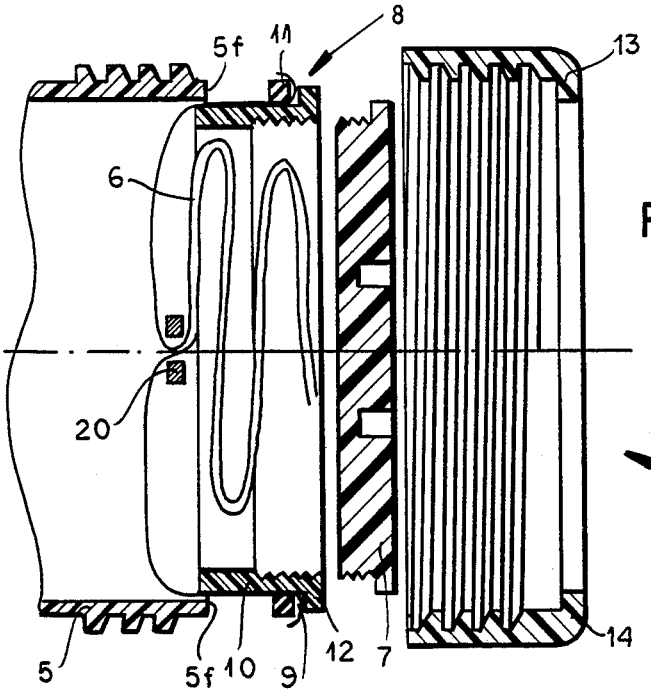
FIG. 4 is an exploded cross sectional view of the object shown in FIG. 2.
Figure 6:
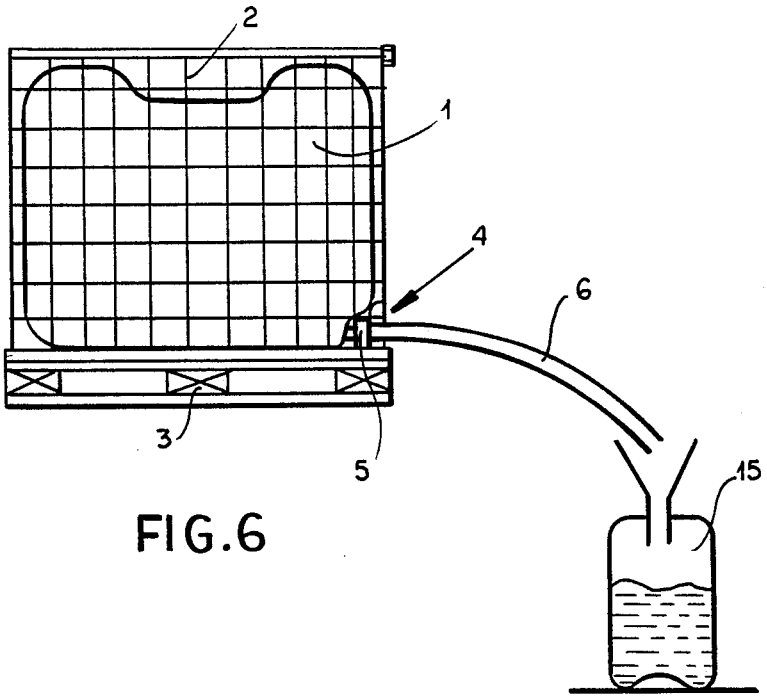
FIG. 6. is a side elevational view of the fluid container according to FIG. 1 with fluid being dispensed.
Figure 7:
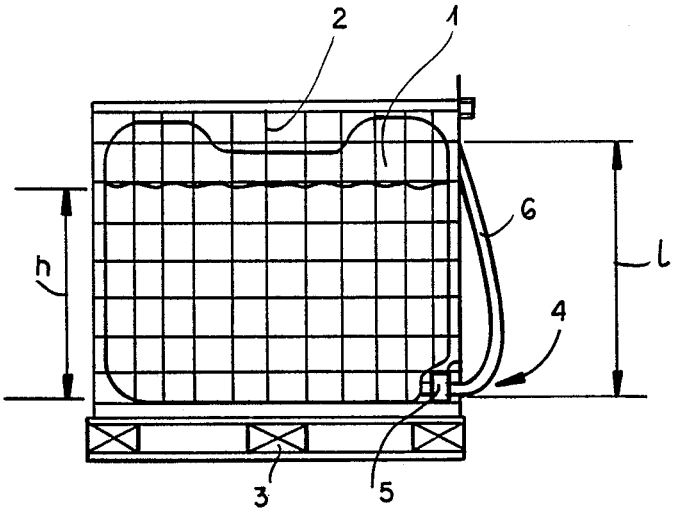
FIG. 7 is a side elevational view of the fluid container according to FIG. 1 in another configuration.

In FIG. 1 as well as FIGS. 6 and 7 is illustrated a fluid container 1 which is blown from a synthetic resin material or thermoplastic and is inserted in a special reinforcing cage 2.

The reinforcing cage 2 is provided on a pallet 3 so that the fluid container 1 can be used as a transporting and storing container (see, for example, European Patent 86 440 071.8).

The fluid container 1 is provided with an outlet device 4. The outlet device 4 basically comprises an outlet pipe 5 and an outlet hose 6 connected with the outlet pipe 5. The outlet hose 6 is replaceable.

FIGS. 2 to 5 show that the outlet hose 6 is a multiply foldable hose made of flaccid rubber or plastic and is attached to the interior or inside of the outlet pipe 5. The outlet pipe 5 is exteriorly closable by a cover 7. The folded together outlet hose 6 (see particularly FIGS. 2 to 4) in front of the cover 7 inside in the outlet pipe 5 is sealable or closable by a clamping device 8. The outlet hose 6 has a length 1 which is greater than the corresponding maximum height h of the fluid level in the fluid container 1 referring to FIG. 7. A clamp 20 may be provided on the hose 6 if desired although the folding may be sufficient to provide the desired sealing effect.

The outlet hose 6 is inserted with a connecting edge 9 in a gap between the interior wall 5*i* of the outlet pipe 5 and a mounting ring 10. It is held by a sealing ring 11 placed on the front surface 5*f* of the outlet pipe 5. The sealing ring 11 for its part together with the substantially interposed connecting edge 9 is held by an exteriorly directed clamping collar 12 on the mounting ring 10. A screw collar ring 13 which locks the mounting ring 10 with an interior collar 14 is screwed on the outside of the outlet pipe 5. The cover 7 is screwed in the mounting ring 10. The mounting ring 10, the screw collar ring 13 and the cover 7 are appropriately made from plastic. In this example also the fluid container 1 is a plastic container with the outlet pipe 5 molded on it.

When the cover 7 is removed the outlet hose 6 is driven out of the pipe 5 under the hydrostatic pressure of the fluid.

Figure 5:
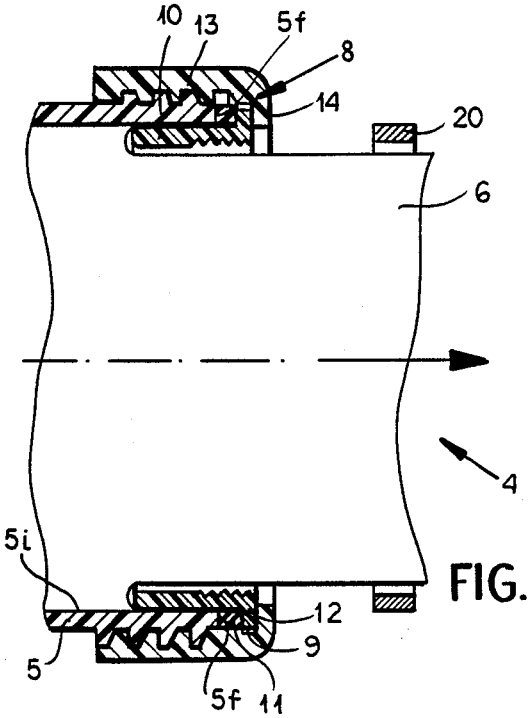
FIG. 5 is a cross sectional view of the outlet device of FIG. 2 in the fluid dispensing configuration.
Figure 8:
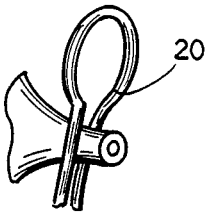
FIG. 8 is a fragmentary perspective view showing the clamping device which may be used.

Furthermore the mouth of the outlet hose 6 can be taken and put in a receiving vessel 15. That is shown in FIG. 6. As has already been indicated in FIG. 7 the mouth of the outlet hose 6 can be lifted up so that the fluid discharge process can be interrupted hydrostatically. The clamp 20 can be removed or simply shifted so that its eye surrounds the hose (FIG. 5).

By "hydrostatically flexible outlet hose" in the following claims we mean a hose which can be folded up when not filled with a fluid but will expand and fill up to form a cylindrical tube under the hydrostatic pressure of an applied fluid without leaking the fluid. A hose of this nature can be made of rubber or plastic film or foil.

We claim:

1. In an outlet device for a fluid container with an outlet pipe and with an outlet hose connected to said outlet pipe, said outlet hose being replaceable, the improvement wherein said outlet hose is made of rubber or plastic and is attached to the inside of said outlet pipe, said outlet pipe is closable exteriorly by a cover and said outlet hose folded together in front of said cover is closed inside in said outlet pipe by a clamping device, said outlet hose with a connecting edge being inserted in a gap between the inner wall of said outlet pipe and a mounting ring and is held by a sealing ring placed on the front surface of said outlet pipe which for its part is held by an exteriorly directed clamping collar on said mounting ring, and a screw collar ring which retains said mounting ring with an interior collar is exteriorly screwed on said outlet pipe.

2. The improvement according to claim 1 wherein said outlet hose has a length which is greater than the maximum height of the fluid level in said fluid container.

3. The improvement according to claim 1 wherein said cover is screwed on in said mounting ring.

4. The improvement according to claim 1 wherein said mounting ring, said screw collar ring and said cover are made from plastic.

5. A liquid storage and transport vessel comprising;

a cage mounted on a pallet;

a plastic container in said cage and an outlet device for said container comprising:

an outlet pipe connected at the bottom of said fluid container, a rubber or plastic outlet hose connected replaceably inside said outlet pipe whose length is greater than the maximum height of the fluid level in said fluid container, said outlet hose having a connecting edge insertable in a gap between the inner wall of said outlet pipe and a mounting ring and retainable by a sealing ring placed on the front surface of said outlet pipe which for its part is held by an exteriorly directed clamping collar on said mounting ring, a screw collar ring retaining said mounting ring with an interior collar being exteriorly screwed on said outlet pipe, and a cover which screws in said mounting ring to close said outlet pipe with said outlet hose folded together in front of said cover lockable inside said outlet pipe.

6. In an outlet device for a fluid container with an outlet pipe and with an outlet hose connected to said outlet pipe, said outlet hose being replaceable, the improvement wherein said outlet hose is made of rubber or plastic and is attached to the inside of said outlet pipe, said outlet pipe is closable exteriorly by a cover and said outlet hose folded together in front of said cover is closed inside in said outlet pipe by a clamping device, said outlet hose with a connecting edge is inserted in a gap between the inner wall of said outlet pipe and a mounting ring and is held by a sealing ring placed on the front surface of said outlet pipe which for its part is held by an exteriorly directed clamping collar on said mounting ring, and a screw collar ring which retains said mounting ring with an interior collar is exteriorly screwed on said outlet pipe.

7. The improvement according to claim 6 wherein said cover is screwed in said mounting ring.

8. The improvement according to claim 6 wherein said mounting ring, said screw collar ring and said cover are made from plastic.

* * * * *